US007484441B2

(12) United States Patent
Wu

(10) Patent No.: US 7,484,441 B2
(45) **Date of Patent: *Feb. 3, 2009**

(54) ELECTRIC WRENCH WITH A CONTROL SWITCH

(75) Inventor: Arthur Wu, Taichung Hsien (TW)

(73) Assignee: Pro Xene Tools Co., Ltd., She kou Village, Shen Kong Hsiang Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/477,119

(22) Filed: Jun. 29, 2006

(65) Prior Publication Data

US 2008/0000332 A1 Jan. 3, 2008

(51) Int. Cl.
*B25B 13/16* (2006.01)
*B25B 21/00* (2006.01)

(52) U.S. Cl. ..... 81/170; 81/165

(58) Field of Classification Search ..... 81/170–172, 81/165, DIG. 5

See application file for complete search history.

(56) References Cited

U.S. PATENT DOCUMENTS

| | | | | | |
|---|---|---|---|---|---|
| 4,333,366 | A * | 6/1982 | Hurtig | ..... | 81/170 |
| 4,512,221 | A * | 4/1985 | Picone | ..... | 81/170 |
| 5,682,802 | A * | 11/1997 | Mazzone | ..... | 81/127 |
| 6,230,591 | B1 * | 5/2001 | Ling et al. | ..... | 81/63 |
| 6,463,811 | B1 * | 10/2002 | Putney | ..... | 73/862.21 |
| 6,477,921 | B1 * | 11/2002 | Picone | ..... | 81/170 |
| 7,263,916 | B1 * | 9/2007 | Wu | ..... | 81/57.14 |

* cited by examiner

*Primary Examiner*—Hadi Shakeri

(57) ABSTRACT

An electric wrench with a control switch comprises a wrench body having a web area, on top of which includes a fixed jaw at one end and a movable jaw on the other end that can slide toward the fixed jaw along a slide slot. The web area further includes a first receptacle for housing a worm gear that is engaged with the movable jaw. The handle contains a second receptacle for housing a driving unit for driving the worm gear. The four lateral sides form a pair of grip sides for a holding hand and a pair of control panels on at least one of which control panels a button or rocker switch is provided, preventing accidental touch by the holding hand.

5 Claims, 7 Drawing Sheets

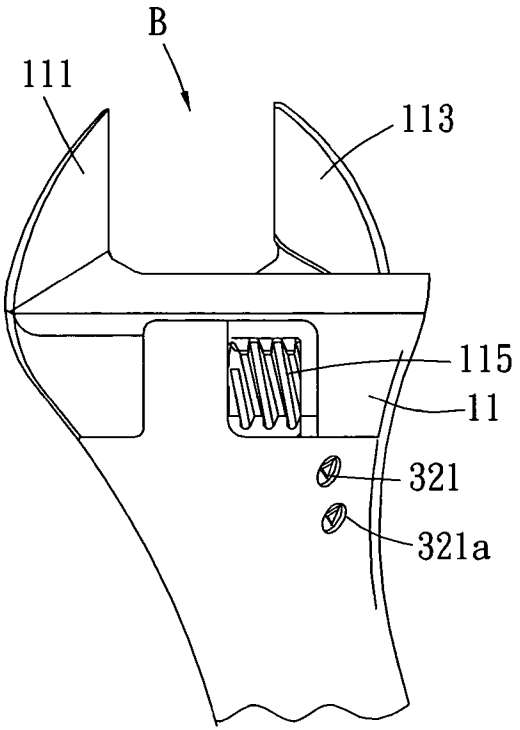
FIG. 3
Replacement Sheet

ELECTRIC WRENCH WITH A CONTROL SWITCH

FIELD OF THE INVENTION

The present invention relates to wrenches, more particularly to an electric wrench with a control switch capable of preventing unwanted sliding of a movable jaw induced by accidental touch of the switch.

BACKGROUND OF THE INVENTION

The electric wrenches disclosed by U.S. Pat. Nos. 4,512,221 and 6,477,921 have a switch installed on one lateral side of the handle, which is easy to be activated by a holding hand during an operation. It can also be activated by accidental collision with a foreign object. Further, the extension of the switch on the otherwise smooth handle is visually harsh.

SUMMARY OF THE INVENTION

Accordingly, the primary objective of the present invention is to provide an electric wrench with a control switch capable of preventing unwanted sliding of the movable jaw of the wrench due to activation of the switch by accidental collision or touching.

The secondary objective of the present invention is to provide an electric wrench with a control switch that will make the electric wrench more visually appealing.

The various objects and advantages of the present invention will be more readily understood from the following detailed description when read in conjunction with the appended drawings.

BRIEF DESCRIPTION OF THE DRAWINGS

FIG. 3 shows the web area of the electric wrench when the control switches are not activated.

DETAILED DESCRIPTION OF THE PREFERRED EMBODIMENTS

Figure 1:
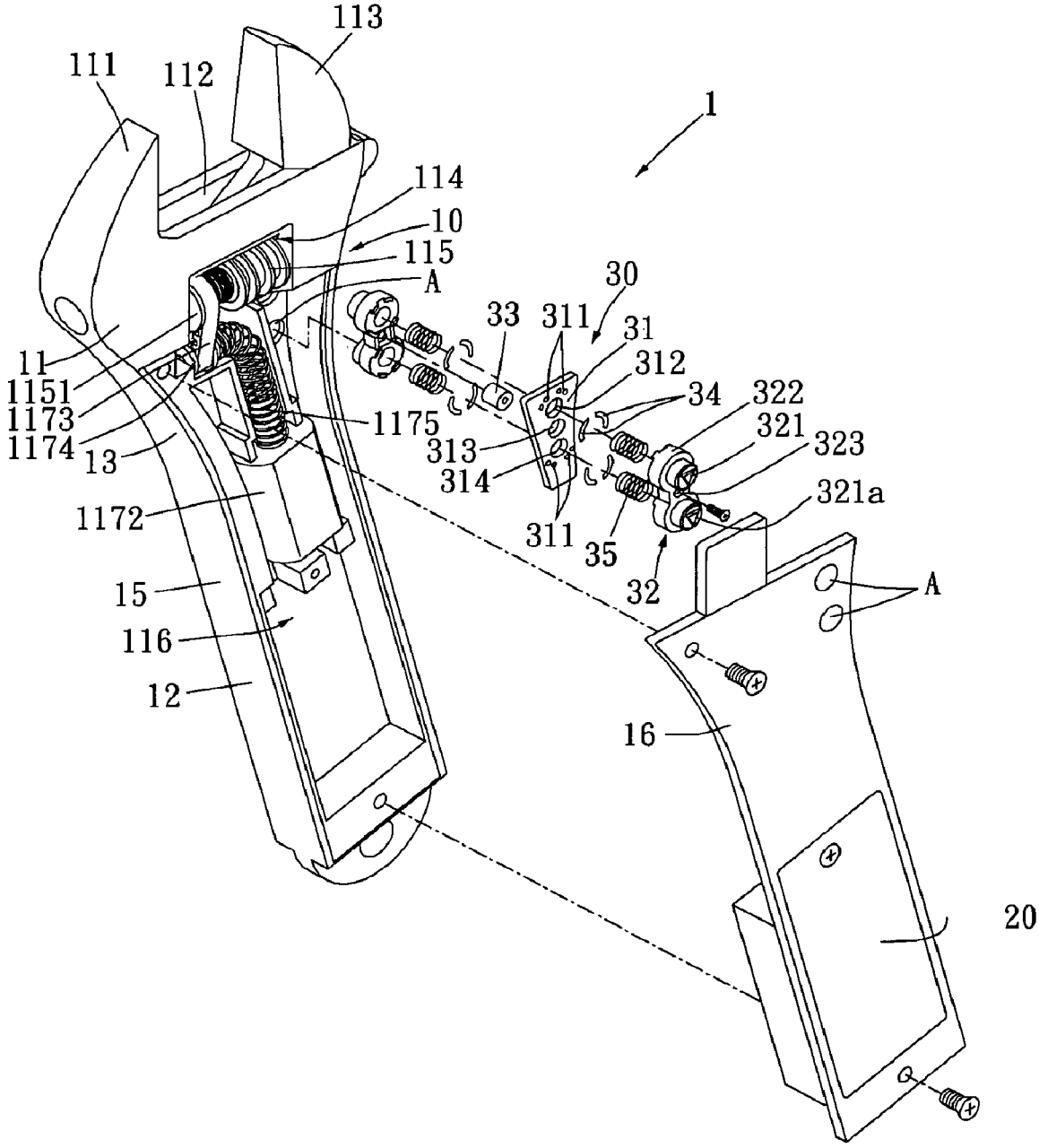
FIG. 1 is an exploded perspective view of an electric wrench of the present invention.
Figure 2:
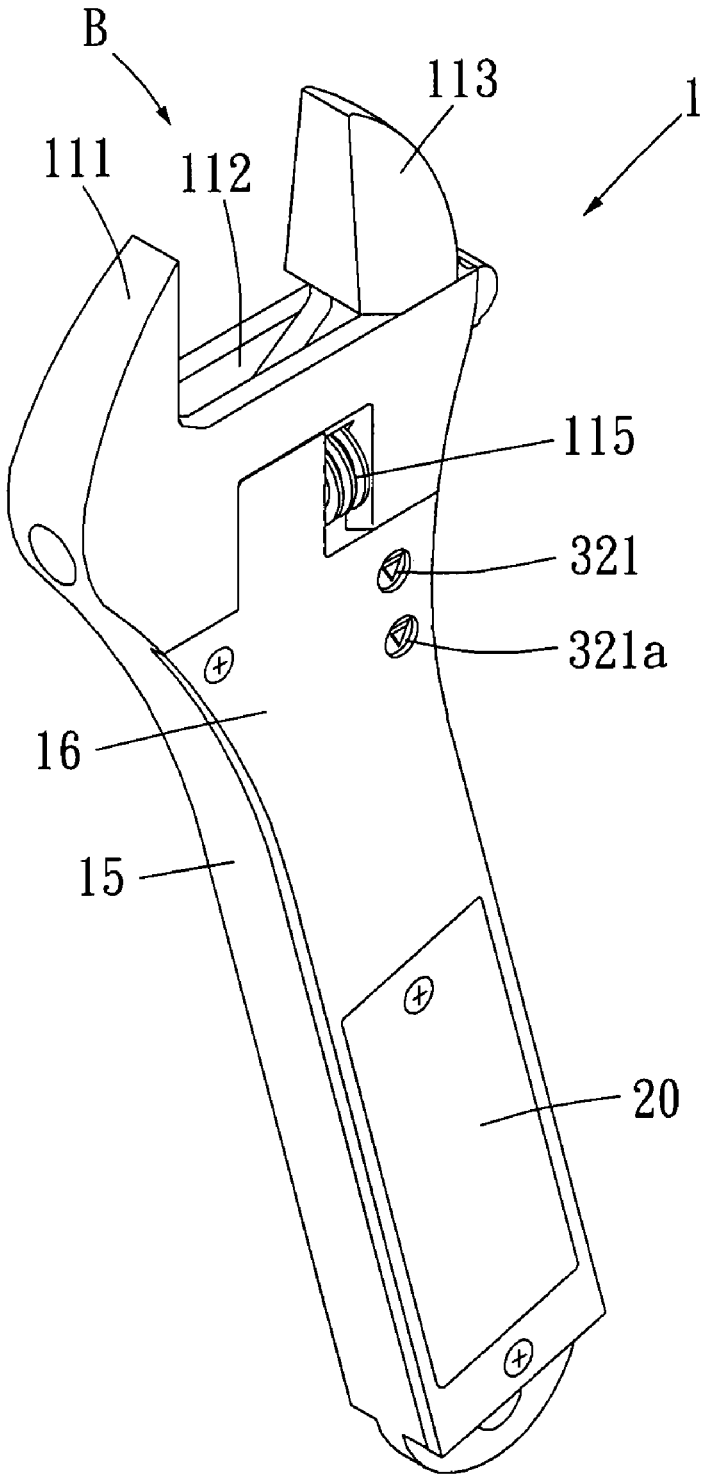
FIG. 2 is a perspective view of the electric wrench in FIG. 1.

Referring to FIGS. 1 to 3, an electric wrench with a control switch comprises main body 1 having a wrench body 10 and a side cover 20. The main body 1 further includes a web area 11, a handle 12 and a neck 13 connecting the web area 11 and the handle 12. One side on the top of the web area 11 is provided with a fixed jaw 111 and the other side with a movable jaw 113 that can slide toward the fixed jaw 111 along a slide slot 112 The movable jaw 113 has its bottom side provided with a sequence of gear teeth (not shown in the figures) for the engagement with an external driving means. The web area 11 further includes a receptacle 114 connecting the slide slot 112 and having a worm gear 115 that is engaged with the movable jaw 113. Further, the handle 12 and the neck 13 contain an internal receptacle 116 for housing a driving unit for driving the worm gear 115. The driving unit consists of a motor 1172 housed in the wrench body 10 under the side cover 20, a secondary gear wheel 1174 connected to the main wheel body 1151 by a belt 1173 and a spring-like transmission member 1175 connecting the motor 1172 and the secondary gear wheel 1174.

The four lateral sides surrounding the handle 12 and the neck 13 are a pair of opposite grip sides 15 and a pair of opposite control panels 16. The neck portion of each of the control panels 16 has a pair of through holes A for retaining two symmetric control switch parts 30. There can also be one control switch part 30 extended from one of the control panels 16.

Each of the control switch parts 30 further comprises a common retaining plate 31 and a set of upper hole 312, middle hole 313, and lower hole 314. The surfaces of the control switch parts 30 are attached with a power supplying unit (battery) and connection points 311 of positive and negative polarities for the motor.

Each of the opposite and symmetrically placed control button sets 32 is respectively provided with a first button 321 and a second button 321*a* marked with "left" and"right", which are extended out of the through holes A on a corresponding one of the control panels 16. The control button sets 32 are mounted within the receptacle 116 by respective button mounts 322.

The hinge column 33 goes through the central hole 313 of retaining plate 31, with two ends connecting respective bridging necks 323 of the control button sets 32, whereby the first buttons 321 and the second buttons 321a can be precisely touched.

Four conducting pieces 34 are installed between the button mounts 322 of the control button sets 32.

Two pairs of springs 35 are installed on the inner sides of the button mounts 322 for restoring the initial positions of the first buttons 321 and the second buttons 321*a*.

Referring to FIG. 2, the control switch parts 30 are located in the neck 13 of the wrench body 1, and the first buttons 321 and the second buttons 321*a* are lower than the most bulged portions on the control panels 16, whereby the contour of the wrench body will be smooth and accidental touch by the holding hand will be prevented. Therefore, well adjusted movable jaw 113 will not change during an operation. The low position of the buttons (321, 321*a*) can further avoid collision with surround foreign objects. The smooth contour of the wrench body 1 allows itself to be placed stably on a flat surface.

Figure 5:
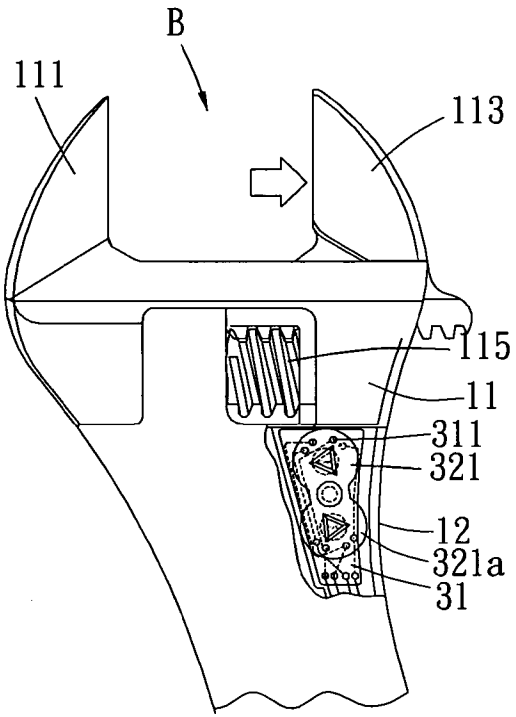
FIG. 5 shows the web area of the electric wrench when a second button of a control switch is activated.
Figure 4:
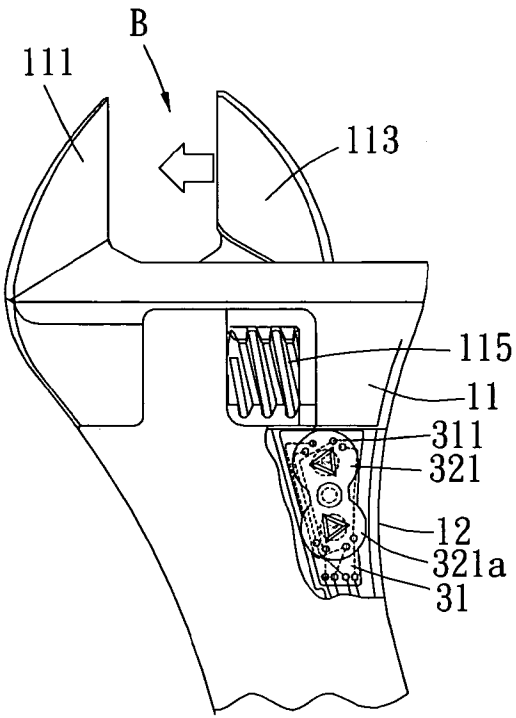
FIG. 4 shows the web area of the electric wrench when a first button of a control switch is activated.

Referring to FIGS. 3 to 5, to reduce the clip opening B of the fixed jaw 111 and the movable jaw 113 (FIG. 4), either one of the first buttons 321 is pressed, whereby the worm gear 115 will drive the movable jaw 113 to slide toward the fixed jaw 111. In the reverse way, the clip opening B is widened by pressing either one of the second buttons 321*a*, whereby the worm gear 115 will drive the movable jaw 113 to slide away from the fixed jaw 111. Therefore, the electrical wrench is easy to operate.

Figure 6:
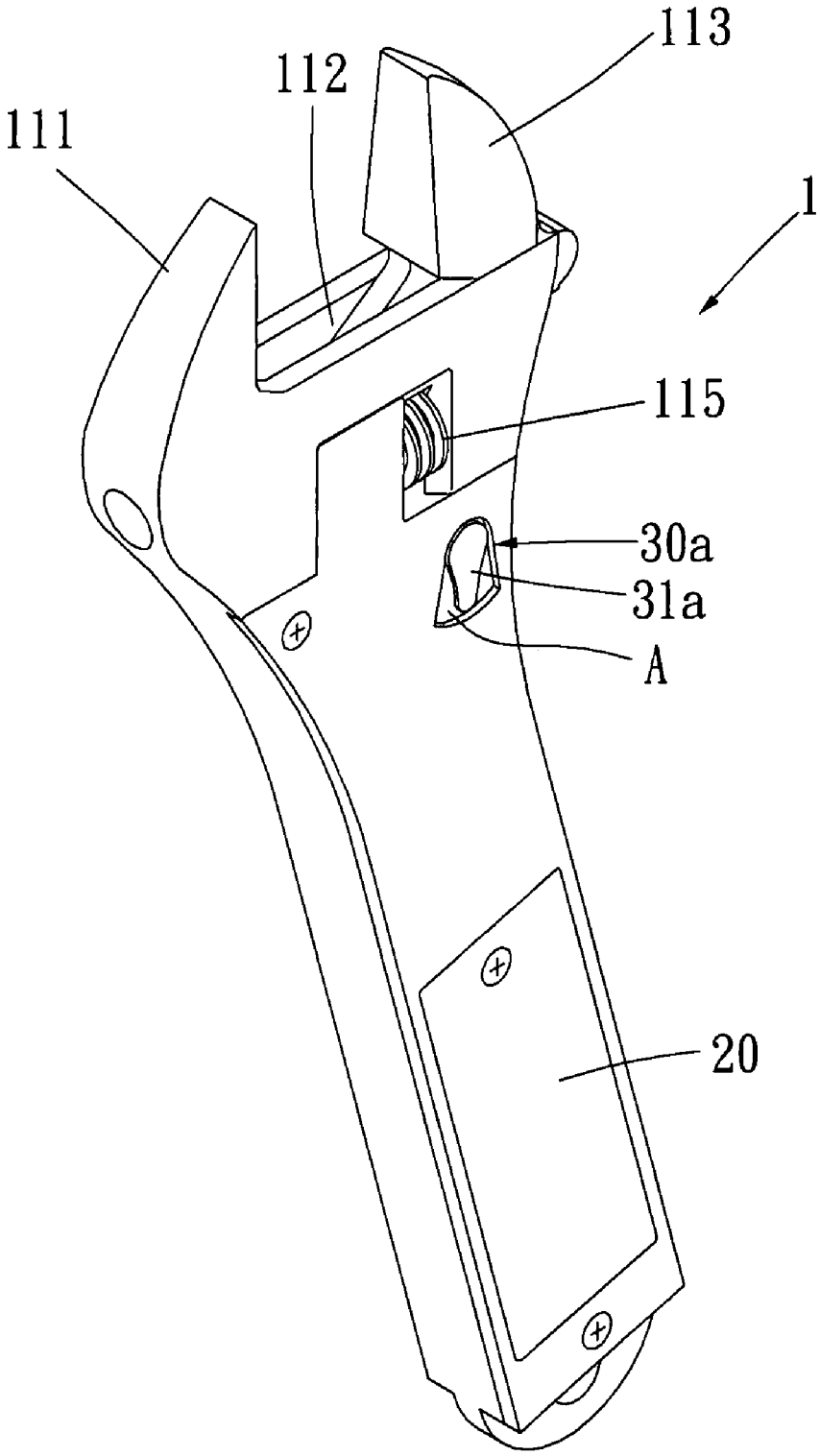
FIG. 6 is a perspective view of the second preferred embodiment of the present invention.
Figure 9:
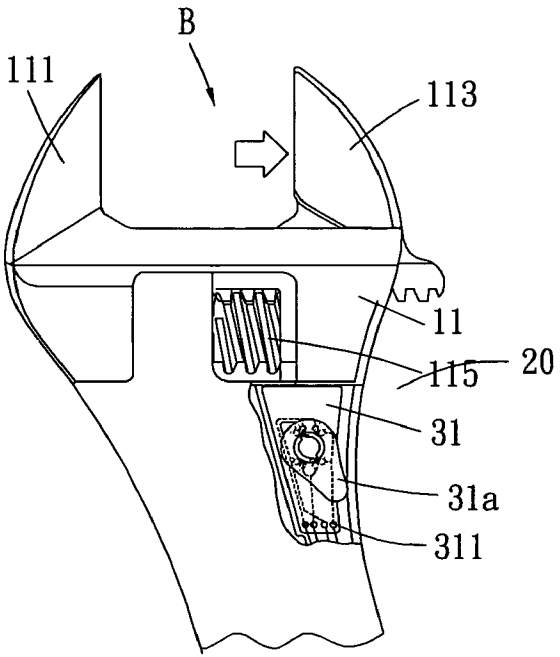
FIG. 9 shows the web area of the second preferred embodiment when a second button of a control switch is activated.
Figure 8:
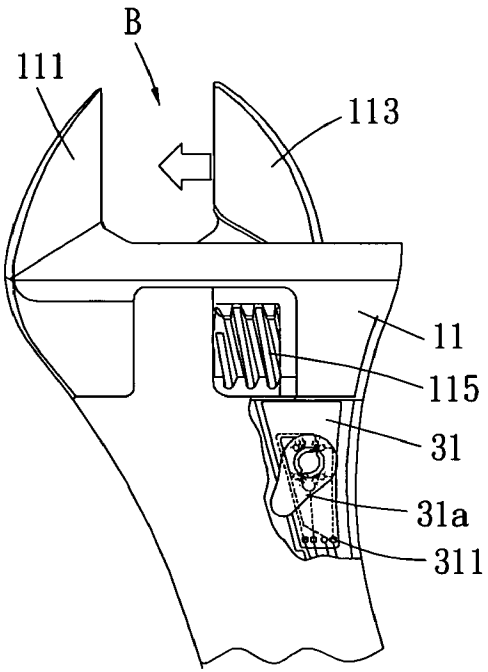
FIG. 8 shows the web area of the second preferred embodiment when a first button of a control switch is activated.
Figure 7:
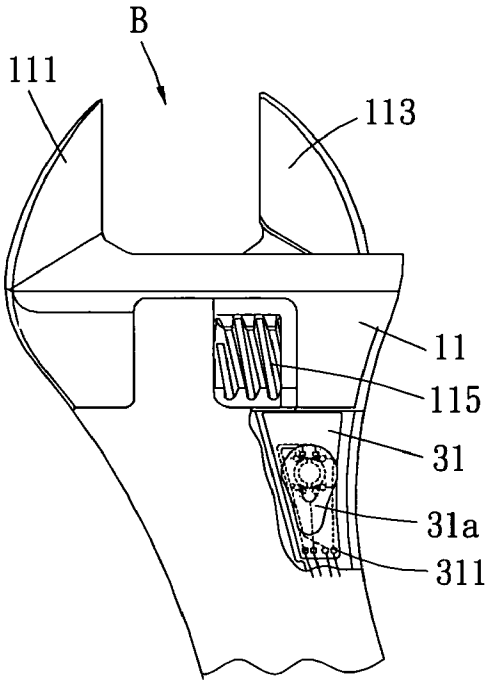
FIG. 7 shows the web area of the second preferred embodiment when the control switches are not activated.

Referring to FIG. 6, the second preferred embodiment of the present invention has the push buttons (321, 321*a*)

replaced by rocker switches 30*a* each having a single rocker piece 31*a*. As shown in FIGS. 7 to 9, the rocker piece 31*a* is tilted toward the fixed jaw 111 so as to slide the movable jaw 113 toward the fixed jaw 111, whereby the clip opening B is shrunk. As shown in FIGS. 8 to 9, the rocker piece 31*a* is tilted away from the fixed jaw 111 so as to slide the movable jaw 113 away from the fixed jaw 111, whereby the clip opening B is widened.

It is mostly important to know the height of the rocker piece 31*a* is slightly lower than the control panels 16 for the same reasons of the first preferred embodiment.

Figure 10:
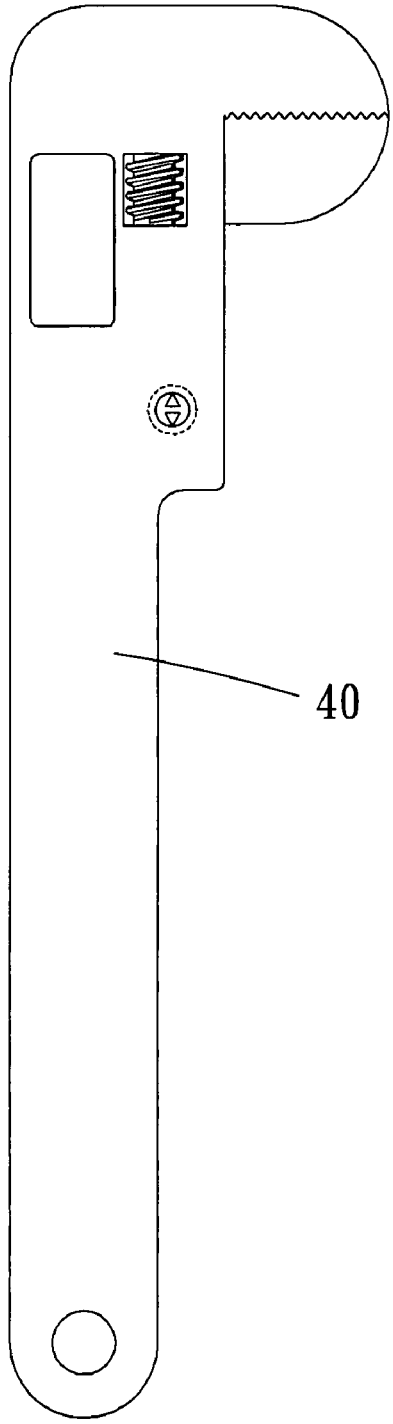
FIG. 10 is the control switch of the present invention used on an alligator wrench.
Figure 11:
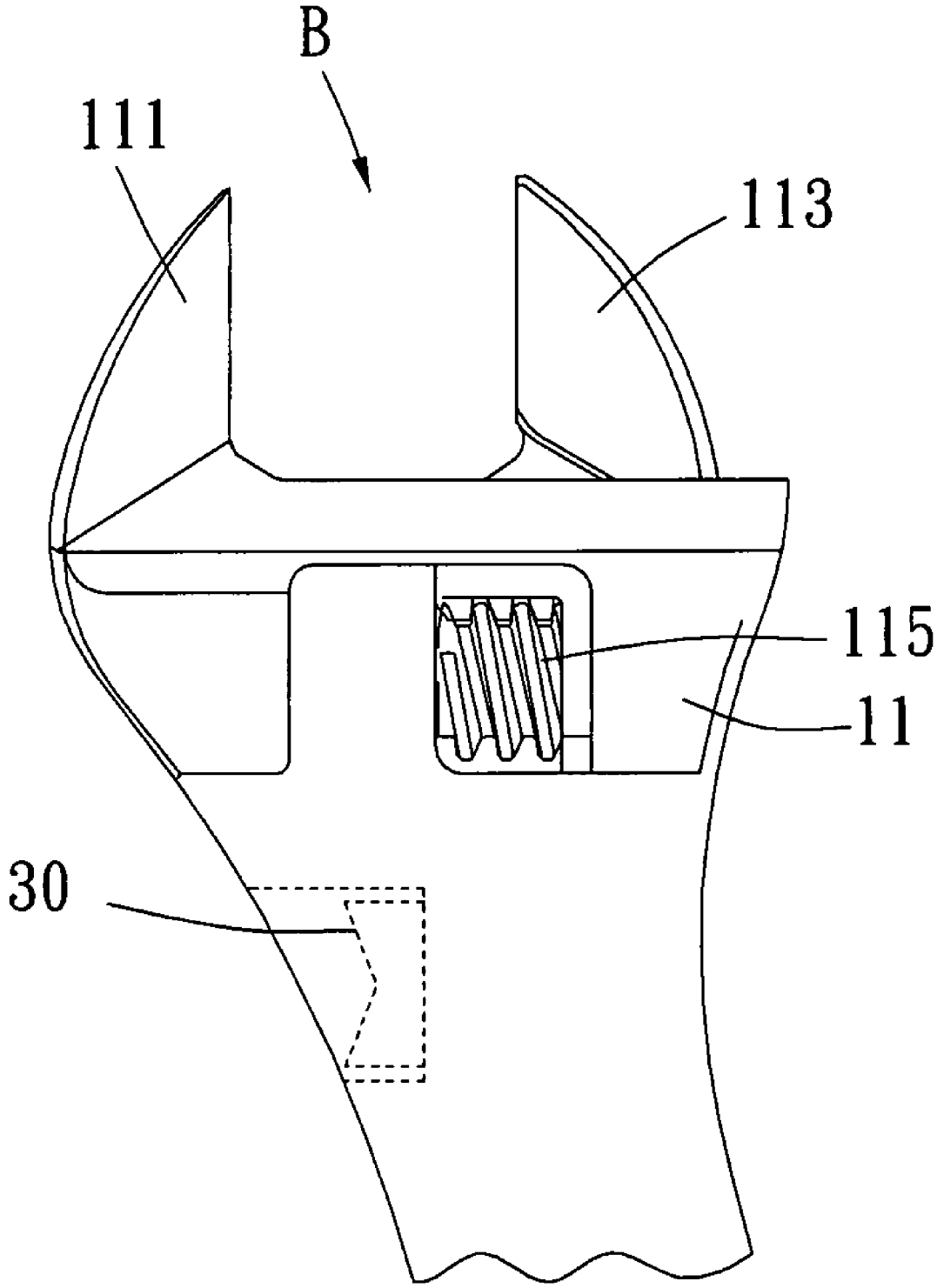
FIG. 11 is the control switch of the present invention installed on one of the grip sides.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims. For example, the control switch of the present invention can also be applied to alligator wrenches 40, as shown in FIG. 10. The control switch can also be installed on one of the grip sides as long as the switch is installed below the surface contour, as shown in FIG. 11.

What is claimed is:

1. An electric wrench with a control switch, comprising:

a wrench body having a web area, a handle and a neck between said web area and said handle, said web area further including a fixed jaw at a left end on a top side thereof and a movable jaw to the right of said fixed jaw that can slide toward said fixed jaw along a slide slot, said web area further including a first receptacle connecting said slide slot for housing a worm gear that is engaged with said movable jaw, said handle and said neck containing a second receptacle for housing a driving unit for driving the worm gear and a power supply unit for powering said driving unit, outer periphery of said neck and said handle being enclosed a pair of opposite grip sides and a pair of opposite control panels, at least one of said control panels being provided with a control switch, wherein said control switch consists of two buttons defining a control button set mounted within said second receptacle by a button mount, a retaining plate, a support column going through said retaining plate supporting said button mount, four conducting pieces attached to said button mount connected to said buttons and a pair of springs tilting against said button mount;

a side cover that is attached onto one of the control panels of said wrench body by a screw, whereby said driving unit housed in said handle will be concealed; and wherein control buttons of said control switch are recessed to and lower than a surface of said control panel.

2. The electric wrench of claim 1 wherein each of said control panel being provided with a control switch, said control switches being retained by said control panels on said wrench body covered by said side cover, a plurality of through holes on said control panels retaining the control button sets.

3. The electric wrench of claim 1 wherein said control switch is marked by a direction mark consistent with the slide direction of said movable jaw.

4. The electric wrench of claim 1 wherein said wrench body is an alligator wrench.

5. The electric wrench of claim 1 wherein said control switch is located near a neck portion of said at least one of said control panels.

* * * * *